US010532388B2

(12) United States Patent
Seibert et al.

(10) Patent No.: US 10,532,388 B2
(45) Date of Patent: Jan. 14, 2020

(54) BENDING PRESS

(71) Applicant: Bystronic Laser AG, Niederönz (CH)

(72) Inventors: Friedemann Seibert, Winterbach (DE); Raymond Arndt, Gotha (DE); Karsten Trutvetter, Gotha (DE)

(73) Assignee: BYSTRONIC LASER AG, Niederdenz (CH)

( * ) Notice: Subject to any disclaimer, the term of this patent is extended or adjusted under 35 U.S.C. 154(b) by 299 days.

(21) Appl. No.: 15/516,997

(22) PCT Filed: Sep. 29, 2015

(86) PCT No.: PCT/IB2015/057453
§ 371 (c)(1),
(2) Date: Apr. 5, 2017

(87) PCT Pub. No.: WO2016/055906
PCT Pub. Date: Apr. 14, 2016

(65) Prior Publication Data

US 2017/0297074 A1 Oct. 19, 2017

(30) Foreign Application Priority Data

Oct. 6, 2014 (DE) ..... 20 2014 007 901 U

(51) Int. Cl.
*B21D 5/02* (2006.01)
*B21D 37/14* (2006.01)
(Continued)

(52) U.S. Cl.
CPC ..... *B21D 5/0254* (2013.01); *B21D 37/04* (2013.01); *B21D 37/145* (2013.01);
(Continued)

(58) Field of Classification Search
CPC .. B21D 5/0236; B21D 5/0254; B21D 5/0281; B21D 37/04; B21D 37/145; B21D 37/147; A47B 81/00
(Continued)

(56) References Cited

U.S. PATENT DOCUMENTS 5,692,867 A * 12/1997 Kondo ..... B23P 19/001 414/268
5,720,535 A * 2/1998 Mehman ..... E05B 65/462 312/218
(Continued)

FOREIGN PATENT DOCUMENTS

CN 202343746 7/2012
EP 2138247 A2 12/2009
(Continued)

OTHER PUBLICATIONS

Press—Google Definition Mar. 26, 2019 (Year: 2019).*
(Continued)

*Primary Examiner* — David B Jones
(74) *Attorney, Agent, or Firm* — Jacob Eisenberg

(57) ABSTRACT

Embodiments of the present disclosure relate to a bending press for bending metal sheets, having a top beam and a lower beam, as well as two drawers. The drawers are arranged at both sides of the lower beam as well as within the bending press housing itself and are designed to selectively house bending tools and other parts within the drawers.

16 Claims, 6 Drawing Sheets

(51) Int. Cl.
*B21D 37/04* (2006.01)
*A47B 81/00* (2006.01)

(52) U.S. Cl.
CPC ..... *B21D 37/147* (2013.01); *A47B 81/00* (2013.01); *B21D 5/0281* (2013.01)

(58) Field of Classification Search
USPC ..... 72/466.7
See application file for complete search history.

(56) References Cited

U.S. PATENT DOCUMENTS

| | | | | |
|---|---|---|---|---|
| 2004/0104652 | A1* | 6/2004 | Holmes | A47B 88/00 312/348.3 |
| 2011/0121699 | A1* | 5/2011 | Freimuth | B25H 3/028 312/237 |
| 2014/0225494 | A1 | 8/2014 | Freimuth | |

FOREIGN PATENT DOCUMENTS

| | | | | |
|---|---|---|---|---|
| EP | 2138247 | B1 * | 12/2014 | B21D 37/145 |
| JP | 2014004604 | A | 1/2014 | |
| NL | 1029416 | C1 | 1/2006 | |

OTHER PUBLICATIONS

Drawer—Google Definition Mar. 26, 2019 (Year: 2019).*
Robot—Merriam-Webser Mar. 25, 2019 (Year: 2019).*
Thalmann AG: "www.thalmann-ag.ch Lebensdauer—die Thako-Modelle", Mar. 1, 2013, XP055231533, Retrieved from the Internet: URL:http://www.thalmann-ag.ch/fileadmin/bilder/pdf/dt/Folder_THAKO-de.pdf [retrived on Nov. 26, 2015] cited in the application Siehe "Standardausrüstung".
Translation of Abstract NL1029416.
Translation of Abstract CN202343746.

* cited by examiner

BENDING PRESS

CROSS-REFERENCE TO RELATED APPLICATIONS

The present application is a National stage application of the PCT application PCT/IB2015/057453 filed on Sep. 29, 2015, which claims priority to German patent application DE202014007901.3 filed Oct. 6, 2014.

FIELD OF THE INVENTION

The invention relates to a bending press for bending metal sheets.

BACKGROUND

Metal sheets are bent into a desired shape by means of generic bending presses, also called mechanical press brakes, mostly according to a bending plan. Depending on the type of bend to be created, the corresponding bending tools are provided on the top beam and the lower beam prior to the bending process to be carried out. To complete a bending plan, different bending tools must oftentimes be arranged one after the other on the top beam and on the lower beam.

The bending tools of a bending press are for example stored in a bending tool cabinet and are removed therefrom as needed or are stored therein in the case of non-use of the corresponding bending tool, receptively. Tools are furthermore required for machine maintenance as well as for changing the bending tools.

It is a disadvantage of the known solution that, for equipping the bending press, the bending tools must in each case be transferred from the bending press to the bending tool cabinet and back to the bending press.

From a different technical field, namely from the field of tinsmithery, the company Thalmann Maschinenbau AG, CH-Frauenfeld, offers a swivel bending machine for bending sheet metal adapter plates under the name THAKO, which has a tool drawer with material for the machine maintenance as standard equipment. Exchangeable bending tools, however, are still stored separately.

It is the object of the invention at hand to create a bending press for bending metal sheets, which does not have the above-mentioned disadvantages and which in particular makes it easier for the operator to change bending tools.

SUMMARY

The object is solved by means of the features of the independent claim. Advantageous further developments are specified in the figures and in the dependent patent claims.

According to the invention, at least one drawer is arranged next to the top beam and/or the lower beam and the at least one drawer is designed to accommodate bending tools and/or parts.

The bending press according to the invention is characterized by improved ergonomics, improved process efficiency and low costs. The at least one drawer can for example only be arranged next to the top beam or only next to the lower beam. In the alternative, the at least one drawer can be arranged next to the top beam and next to the lower beam. This at least one drawer can thereby extend in the direction of the height of the bending press, for example across the entire height of the bending press.

The bending tool required for completing a bending plan are directly available to the operator on the bending press and can be easily reached by the operator. For providing the bending tools, the operator does no longer need to transport them between the bending press and a tool cabinet, whereby the expenditure of force for providing the bending tools is significantly reduced. If the bending press is designed in such a manner that the operator mainly operates it sitting down, he needs to get up much less often to change the bending tools than in the case of the previously known bending presses and thereby also needs to leave an ergonomically advantageous position less often. A bending press, in the case of which the at least one drawer is arranged next to the lower beam, is considered to be particularly advantageous, in particular for ergonomic as well as for design reasons.

Parts, such as, e.g., tools, manual or automatic measuring means or measuring devices, further aids, care products for the bending press or even bending parts, are directly available to the operator on the bending press with the above-mentioned advantages.

Due to the fact that the effort for changing the bending tools as well as for the accessibility of parts is significantly reduced in the case of the bending press according to the invention, this has an advantageous effect on the efficiency of the bending press. The bending tools and/or the parts are always directly available in the case of the bending press. In the case of bending presses ("plug and bend"), which can be displaced or transversed respectively, the solution according to the invention is particularly advantageous, because, e.g., a separate bending tool cabinet does not also need to be guided to follow in response to a displacement or transversing.

Due to the fact that the requirement of a separate bending tool cabinet is eliminated, the costs for the procurement thereof are reduced by the elimination on the one hand and by the smaller required space in a production hall on the other hand.

Provision is preferably made for a plurality of drawers, so that a plurality of bending tools and/or parts can be stored directly on the bending press. Advantageously, the plurality of drawers is provided on both sides of the top beam or on both sides of the lower beam, wherein an arrangement on both sides of the lower beam is preferred for ergonomic as well as for design reasons. On one side of the top beam or lower beam, provision can also be made for more than one drawer, which provides in particular for a simple and thus cost-efficient design of the drawer mechanism for the drawers, which are now arranged on top of one another here.

In a further alternative embodiment, the plurality of drawers are provided next to the top beam and the lower beam, so that the number of the bending tools and/or parts stored on the bending press can be increased again.

Provision is preferably made in at least one drawer for at least one bending tool accommodating unit for bending tool, in which the corresponding bending tools can be accommodated, advantageously in an organized manner.

More preferably, provision is made in at least one drawer for at least one part accommodating unit for parts, in which the corresponding parts are accommodated, advantageously in an organized manner. The at least one part accommodating unit can also have cutouts comprising certain angles relative to one another, so that a quality control can be carried out directly on bent bending parts for example.

The at least one part accommodating unit can comprise a beverage holder, which can advantageously be folded out of and folded into the drawer again, or can even be designed as such as beverage holder. A corresponding storage option is thus available to the user, by means of which the risk of an unintentional spilling for example of coffee, fruit juice, soft drink, machine oil or other liquids located in at least partially open containers, is reduced.

Provision is particularly advantageously made in a drawer for at least one bending tool accommodating unit as well as for at least one part accommodating unit, by means of which a plurality of organizing options is available to the user on the bending press.

At least one bending tool accommodating unit and/or at least one part accommodating unit preferably has at least one accommodating holder for at least one bending tool or for at least one part, respectively, by means of which this bending tool or this part, respectively, is held until the removal thereof and does not change its position in response to opening and closing the corresponding drawer. This also prevents, e.g., that a bending tool located in the drawer or a part located in the drawer, respectively, can tip over and can possibly block an opening or a closing of said drawer.

The at least one bending tool accommodating unit and/or the at least one part accommodating unit can preferably be moved out of the at least one drawer, so that the bending tools accommodated therein or the part accommodated therein, respectively, can be easily accessed by the operator.

Advantageously, the at least one bending tool accommodating unit and/or the at least one part accommodating unit can be pivoted out of the at least one drawer, which additionally simplifies the accessibility of the bending tool located therein or of the part located therein, respectively.

Another advantage is that the at least one bending tool accommodating unit and/or the at least one part accommodating unit can be pulled out of the at least one drawer, advantageously at a right angle thereto, which also provides simple accessibility of the bending tool located therein or of the part located therein, respectively.

If provision is made for a plurality of bending tool accommodating units and/or a plurality of part accommodating units in a drawer, all of these bending tool accommodating units and/or part accommodating units can preferably be moved out of the at least one drawer, advantageously pivoted out and/or pulled out, for a simple accessibility of the bending tools located therein or of the parts located therein, respectively. Particularly advantageously, the plurality of bending tool accommodating units and/or part accommodating units can be moved parallel to one another.

In an advantageous alternative, the at least one bending tool accommodating unit and/or the at least one part accommodating unit can be moved out of the drawer via an arrangement, which accommodates the weight of the bending tool accommodating unit and of the bending tools and/or of the part accommodating unit and of the parts. For example, the at least one bending tool accommodating unit and/or the at least one part accommodating unit can also be guided similarly to the drawers via guide rails on a correspondingly designed drawer mechanism and can advantageously also be provided with a pull-out stop.

Advantageously, the at least one bending tool accommodating unit and/or the at least one part accommodating unit can be moved and/or pivoted up to the height of the bending line of the bending press.

In the case of a design, in which at least one bending tool accommodating unit can be moved and/or pivoted to the height of the bending line of the bending press, the transfer of a bending tool from the top beam or the lower beam into the bending tool accommodating unit or vice versa, respectively, is thus significantly simplified for the operator of the bending press through this, for example.

In the case of a design, in which the at least one part accommodating unit can be moved and/or pivoted to the height of the bending line of the bending press, the removal of the corresponding part is thus significantly simplified for the operator through this, for example.

Preferably, provision is made for a holding device for temporarily holding the at least one bending tool accommodating unit and/or the at least one part accommodating unit in the at least one drawer, so that the at least one movable bending tool accommodating unit and/or the at least one movable part accommodating unit cannot unintentionally come out of the accommodating area of the at least one drawer, e.g. in response to opening or closing the at least one drawer.

Advantageously, the holding device is designed mechanically or magnetically, which provides for a simple design thereof. A mechanical holding device preferably comprises a clamping element, which can be brought in operative connection with a corresponding counter element.

Preferably, the at least one drawer can be moved with respect to the housing of the bending press, so that the entire drawer can be transferred into a position, which is advantageous for the operator. Advantageously, the at least one drawer can be pivoted with respect to the housing of the bending press. Particularly advantageously, the at least one drawer can be moved in such a manner that it can serve as additional storage surface for the operator or can be accessed by a third party for removing or for storing tools or parts, respectively.

In an advantageous embodiment, provision is made for an arrangement for moving and/or pivoting the at least one drawer, which simplifies the operation of the bending press.

Provision is preferably made for a motor unit for moving the at least one drawer, by means of which a heavily equipped drawer can also be easily pulled out or pushed in, respectively, and/or moved or pivoted, respectively. Advantageously, the motor unit comprises a motor, which can be operated with the same power means as the bending press. Provision is made for example for a corresponding electric motor. If the bending press has a plurality of drawers, all drawers or at least the drawer comprising the larger dimensions can advantageously be traversed by means of a motor. Instead of a motor unit for each drawer, provision can also be made in the case of a plurality of drawers for fewer motor units, which pull out or push in, or move and/or pivot, respectively, the drawer to be traversed via correspondingly designed drive trains.

Advantageously, this motor unit is sensor-controlled, which ensures a simple operation of the bending press. For example, a contact sensor or a motion sensor is used, which can be easily controlled by the operator by means of touch or a specific movement (e.g. by gestures or moving the foot).

The at least one drawer can preferably be separated from the bending press, so that it can also be used easily by third parties. Advantageously, the at least one drawer can also be accommodated by another, correspondingly designed bending press.

For example, a plurality of drawers are available to the operator, which, e.g., include tools or parts, which are assigned according to a bending series. The operator takes the drawer, which corresponds to his task and which he transfers to the bending press he is to operate, and all of the tools and/or parts required for the bending process are thus available to him. In the alternative, each operator can thus be provided with a personal drawer, which the operator can equip or has equipped himself according to his needs or wishes.

Advantageously, the at least one drawer, which can be separated from the bending press, comprises a traversing unit, by means of which this drawer can be easily repositioned. Particularly advantageously, the traversing unit comprises at least one roller, advantageously a plurality of rollers, on which the at least one drawer can be traversed.

Preferably, provision is made in the at least one drawer for at least one assistance device, which supports the operator or which opens up additional possibilities to him.

Advantageously, the at least one assistance device comprises at least one robot, which can support the operator when handling bending tools and/or parts. This at least one robot can for example be designed as bending robot, which supplies the bending parts to the bending press or removes the bending parts from the bending press, respectively, after the bending process, or which even holds or guides, respectively, the bending parts during the bending process. Such a bending robot provides for an automatic bending of bending parts without permanent presence of the operator at the bending press.

As a further advantage, the at least one assistance device comprises at least one power generating device, by means of which required power can be generated directly on the bending press. For example, the at least one power generating device comprises a compressor for generating compressed air and operation of compressed air devices. In the alternative or in addition, the at least one power generating device comprises a current generator for generating current and operation of electrical devices.

As a further advantage, the at least one assistance device comprises at least one power supply device, by means of which the corresponding power can be distributed. For example, the at least one power supply device comprises a line, which is matched to the corresponding power or a supply tube for a corresponding fluid, such as air, gas or a fuel.

An autonomous operation of the bending press is ensured by means of the at least one assistance device and the installation requirements at the site of the bending press according to the invention can be kept low and significantly smaller than in the case of previously known bending presses, which can be used in this manner.

A plurality of assistance devices can be arranged on a bending press, wherein these assistance devices can at least partially be designed differently. Provision can also be made in a drawer for a plurality, if applicable different or identical assistance devices.

Provision is preferably made for at least one support element, which provides the operator with a further storage option, for example for a bending part. The at least one support element is positioned as needed, advantageously by the operator, according to the desired position. The at least one support element is arranged laterally on the drawer, e.g., or on the front side thereof or directly on the bending press, for example on the housing thereof.

Advantageously, the at least one support element has holding elements, by means of which the at least one support element can be fixed in or on correspondingly designed accommodations. For example, the holding elements of a support element are designed in a hook-shaped manner, so that this support element can be suspended for example on a side wall of the at least one drawer.

In a further advantageous design, the at least one support element has a trough-shaped or box-like design, so that at least one accommodating space for different types of elements or parts is available to the operator.

The at least one support element is preferably arranged on or in the at least one drawer and is thus easily available to the operator and the support element can be stowed easily on or in the at least one drawer when not in use.

Advantageously, the at least one support element can be moved relative to the at least one drawer and can, as a further advantage, be fixed in different angular orientations relative to the at least one drawer. The at least one support element can thus serve as chute to the at least one drawer for bending parts in the case of an angular orientation of greater or smaller than 90°. In the case of an angular orientation of 90° of the at least one support element relative to the at least one drawer, said support element forms an additional support. Particularly advantageously, the at least one support element can be pivoted relative to the at least one drawer.

As a further advantage, provision is made for at least one drive device for moving or for pivoting, respectively, the at least one support element, so that the support element can easily be transferred into the desired position. For example, the at least one drive device comprises at least one motor, in particular an electric motor and/or at least one spring arrangement, e.g. a gas pressure spring.

Provision is preferably made on or in the at least one drawer for at least one conveying device for bending parts and/or bending tools, by means of which the operation of the bending press is additionally simplified. The at least one conveying device comprises passive devices, e.g. a chute, and/or active devices, e.g. an advantageously motor-driven conveyor belt. Advantageously, the at least one conveying device is provided on the at least one support element, thus resulting in a plurality of simplifications for the operator.

Provision is preferably made on or in the at least one drawer for at least one display unit, which displays a position to the operator or which visually informs him about a certain state. For example, the at least one display unit comprises a screen for illustrating different information. In the alternative or in addition thereto, the at least one display unit comprises a light strip, e.g. a plurality of LEDs, which can be controlled individually and which display a position to the operator for storing a bending tool or the bending tool to be removed, for example.

Preferably, the at least one display unit is arranged at the at least one bending tool accommodating unit and/or at the at least one part accommodating unit, so that a corresponding positioning therein is easily ensured by the operator.

Provision is preferably made for at least one electronic or electrical interface on or in the at least one drawer.

For example, the at least one electronic interface comprises a data interface, e.g. a USB or wireless connection, via which data can be exchanged. A screen, on which data of the bending press and/or drawings or work or bending plans, respectively, can be displayed, can further be arranged on the at least one electronic interface.

For example, the at least one electrical interface is designed for charging end devices. The at least one electrical interface can comprise, e.g., induction surfaces, via which devices, which are capable of induction, can be charged.

Provision is preferably made on or in the at least one drawer for at least one sensor, which is designed in accordance with the information to be captured. For example, the presence or absence of a bending tool and/or of a part can be captured by means of the at least one sensor. The at least one sensor can also to control the bending parts and/or the bending tools. Advantageously, the at least one sensor communicates with a computing unit of the at least one drawer and/or with the controller of the bending press.

Preferably, the at least one drawer can be locked, whereby an unintentional opening is prevented as needed. In the locked state, the at least one drawer is blocked, which simplifies the transport of the at least one drawer or of the bending press. Particularly advantageously, the at least one drawer can be locked, so that the content of the at least one drawer cannot be accessed by third parties. The operator can thus securely stow his personal belongings in the at least one drawer. In addition, the operator can be made responsible for the completeness of the bending tools and/or parts.

Further advantages, features and details of the invention follow from the below description, in which exemplary embodiments of the invention are described by referring to the drawings. Features mentioned in the claims and in the description can thereby in each case be significant for the invention, either alone or in any combination.

The list of reference numerals as well as the technical content of the patent claims and figures is part of the disclosure. The figures are described in connection and comprehensively. The same reference numerals signify the same components, reference numerals with difference indices specify components having the same function or similar components.

DETAILED DESCRIPTION OF THE PREFERRED EMBODIMENT

Figure 1:
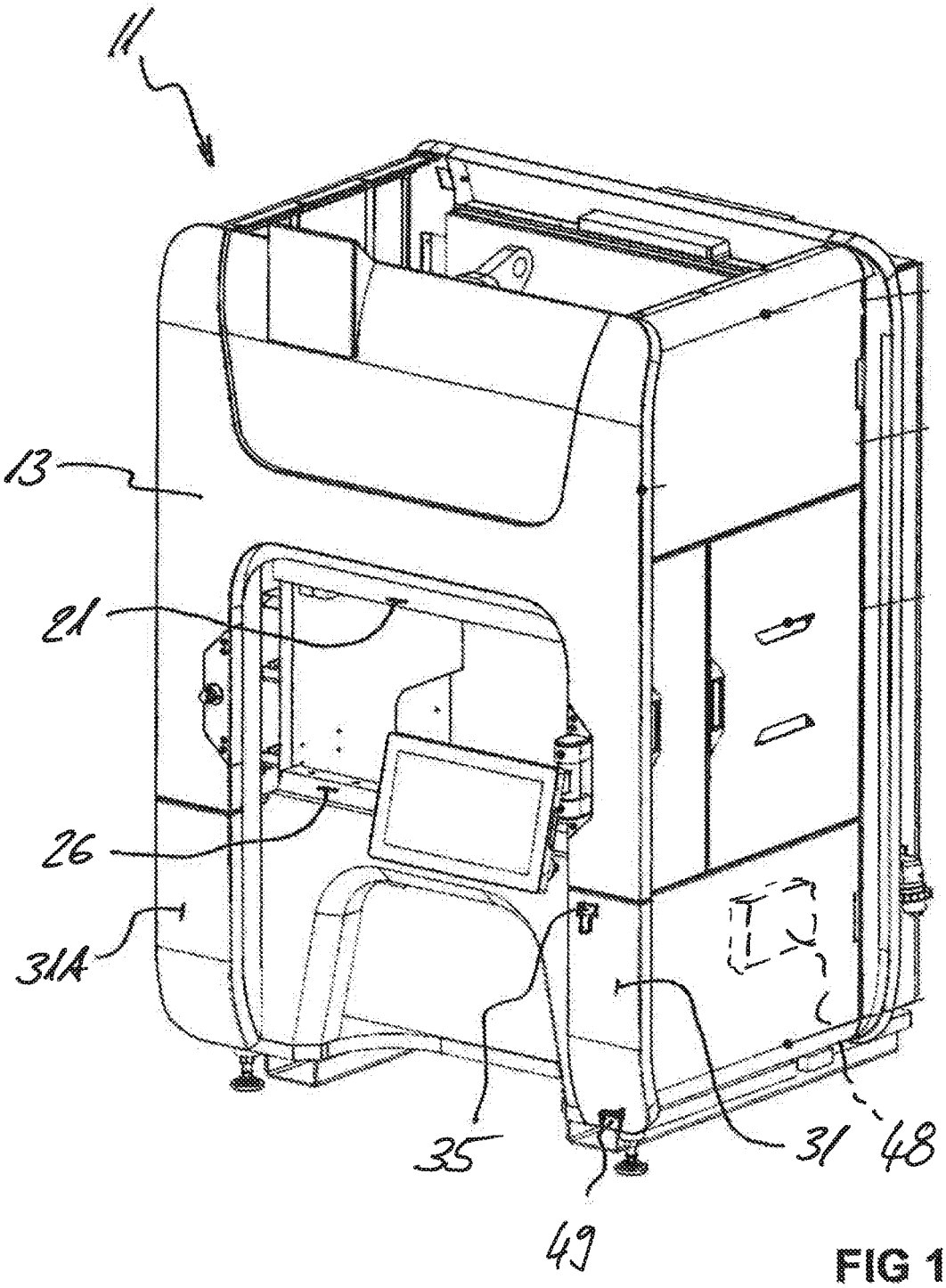
FIG. 1 shows an embodiment of a bending press according to the invention in a perspective view.

The bending press 11 shown in FIG. 1 has a top beam 21 and a lower beam 26, wherein the top beam 21 can be traversed relative to the lower beam 26 for bending metal sheets. Depending on the type of the bend to be created, the corresponding bending tools are provided on the top beam 21 and the lower beam 26. The controller, the drive means for the top beam 21 as well as the other usual components of a common bending press 11 are provided within the housing 13 of the bending press 11.

In the example at hand, two drawers 31, 31A, which are designed for accommodating bending tools, are arranged on both sides next to the lower beam 26. The drawers 31, 31A are integrated in the housing 13 of the bending press 11.

Each drawer 31, 31A is guided via guide rails 34 on a correspondingly designed drawer mechanism, which is provided in the housing 13 of the bending press 11. Provision is advantageously made for a pull-out stop, which prevents that the drawer 31, 31A can inadvertently be pulled too far out of the housing 13 of the bending press 11. Provision can also be made for fixing locks for the drawers 31, 31A, in order to be able to fix the latter in certain positions relative to the housing 13 of the bending press 11 and to thus be able to prevent an unintentional closing thereof.

In this example, the drawer 31 can be traversed via a motor unit 48, wherein this motor unit 48 is controlled via a sensor 49—here designed as motion sensor.

The drawer 31 is provided with a lock 35. The drawer 31 can be locked or blocked, respectively, by means of the corresponding key as locking means.

Figure 2:
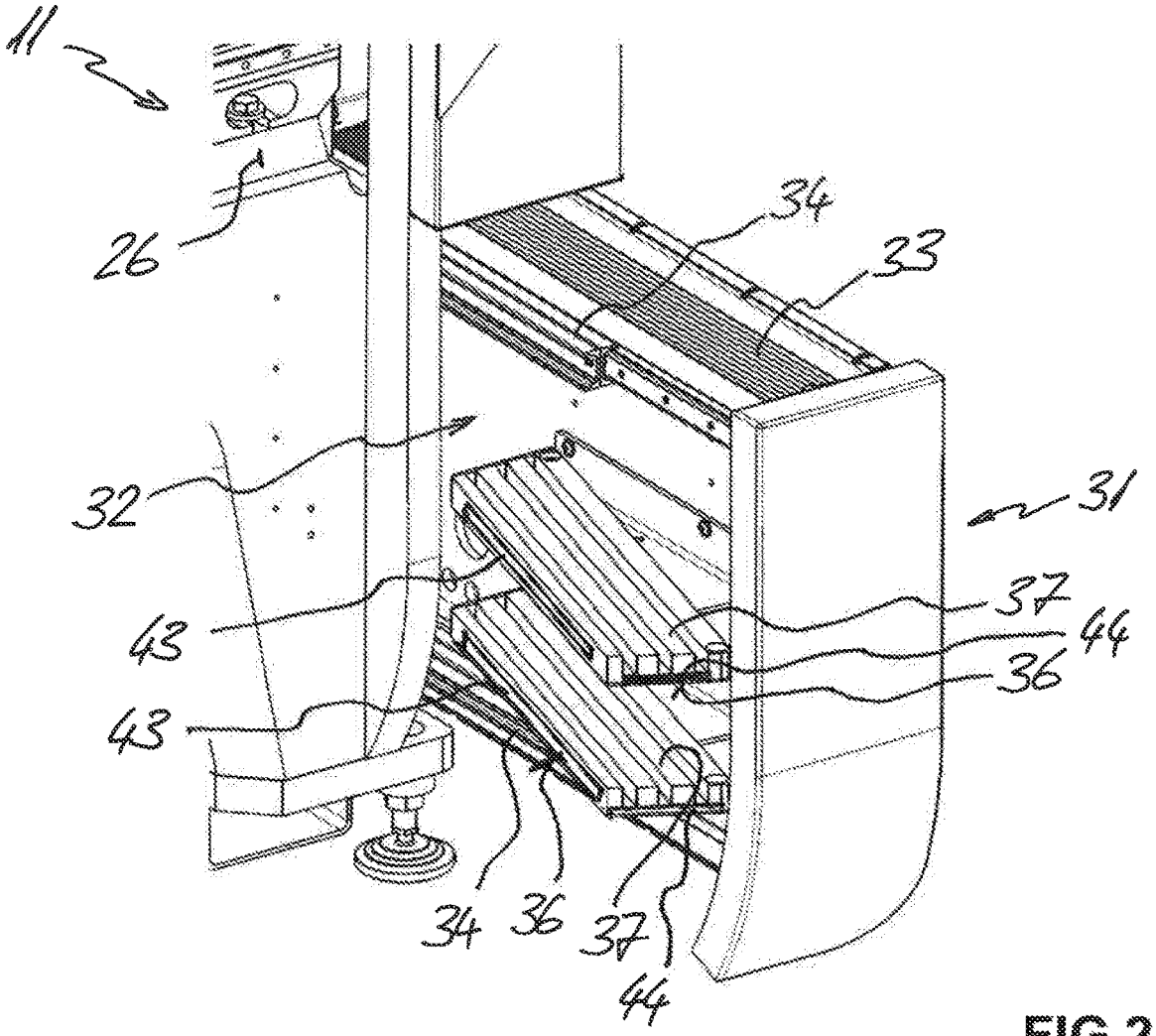
FIG. 2 shows a drawer of the bending press according to the invention according to FIG. 1 in the pulled-out state.
Figure 3:
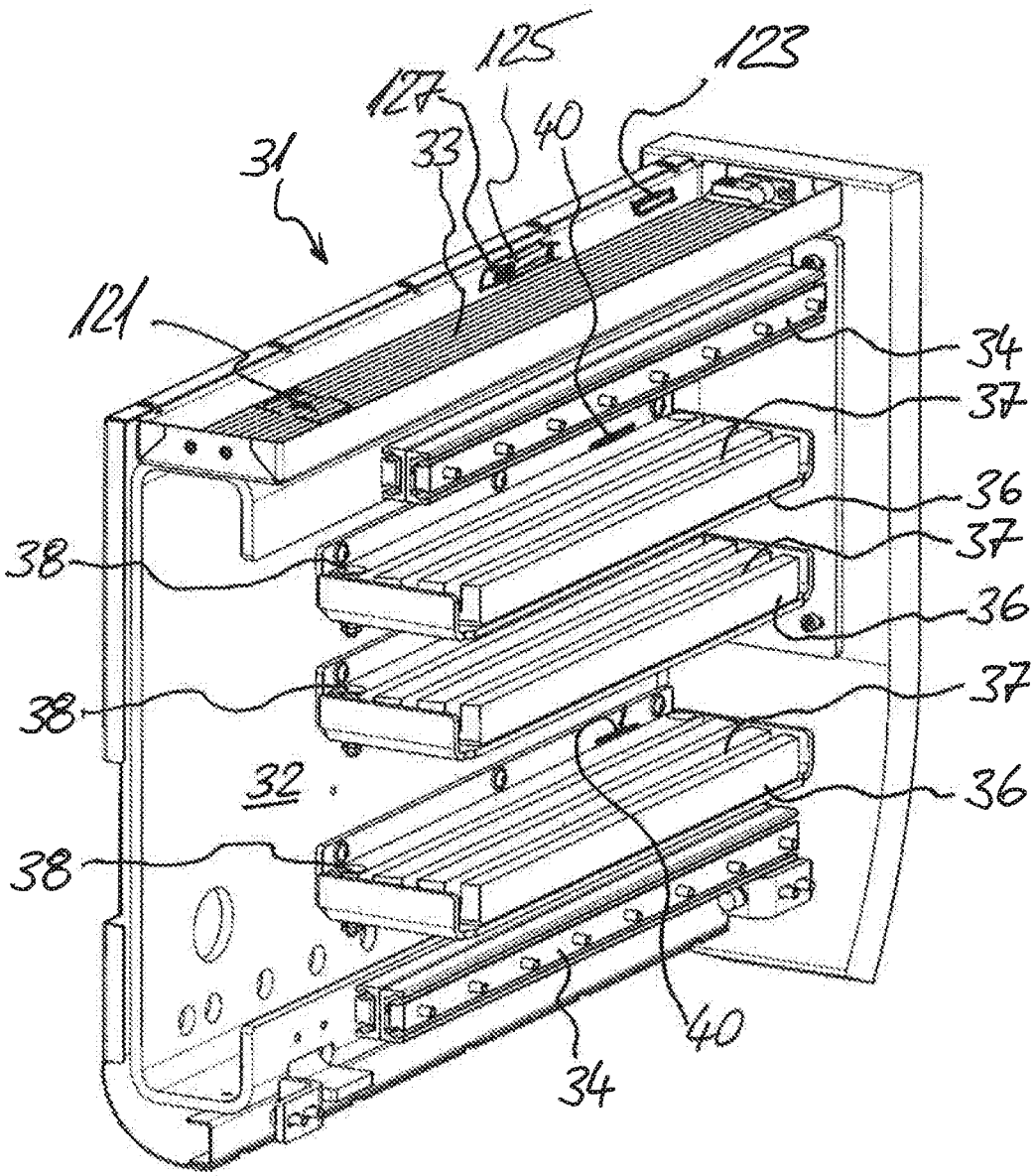
FIG. 3 shows the drawer in a perspective view.

Each drawer 31, 31A further has an accommodating area 32, in which provision is made for a plurality of bending tool accommodating units 36 for bending tools (FIGS. 2 and 3). Each of these bending tool accommodating units 36 has an accommodating holder 37 for a bending tool, in which the bending tool is held in a clamped manner for example. The accommodating holder 37 is made of a foam, for example, and has—in this example—three accommodating slits 39 for accommodating at least three bending tools.

Provision is in each case made on each bending tool accommodating unit 36 for a display unit 43, which runs along the longitudinal extension thereof, as well as a display unit 44, which runs along the transverse extension thereof. These display units 43 and 44 are in each case designed as LED light strips, wherein the individual LEDs can be controlled separately. Via these LEDs, it is displayed to the operator, for example, where he is to store a bending tool, which is no longer needed. For example, it can also be displayed to the operator via these LEDs, which bending tool from the bending tool accommodating unit 36 he is to arrange in the lower beam 26 or the top beam 21 for the next bending process.

Each of the bending tool accommodating units 37 can be moved from the accommodating area 32 of the corresponding drawer 31. In the example at hand (see in particular FIG. 4), each bending tool accommodating unit 37 can be pivoted out of the accommodating area 32 of the drawer 31 about a pivot axis 38, which is defined by a bolt here.

Provision is furthermore made in the drawer 31 for holding devices 40 for temporarily holding the bending tool accommodating units 36. The holding devices 40 have for example a magnet 42, which is arranged on the bending tool accommodating unit 36, and a counter magnet 41, which is arranged on the inner side of the accommodating area 32 of the corresponding drawer 31. The magnet 42 as well as the counter magnet 41 are designed in such a manner that the bending tool accommodating unit 36 is temporarily held in response to opening and closing the drawer, while the available holding force between the magnet 42 and the counter magnet 41, however, can be overcome easily by the operator and advantageously without much expenditure of force.

With regard to the illustration at hand in the upper area of the drawer 31, said illustration has a part accommodating unit 33, which covers the drawer 31 from the top and which at least partially protects the bending tools, which are present in the bending tool accommodating units 36. This part accommodating unit 33 serves for example to accommodate tools for the machine maintenance or for arranging or changing, respectively, bending tools on the top beam 21 and/or the lower beam 26. Measuring means, in particular the measuring means, which are required in response to the bending of the metal sheet, can further also be stored in the tool accommodation 33. All of the work equipment required for operating the bending press 11 are thus directly available to the operator thereof at the bending press 11.

Provision is made in the part accommodating unit 33 for an induction surface as an electrical interface 121, via which devices, which are capable of induction, can be charged as needed. Provision is furthermore made for an electronic interface 123—here in the form of a USB port, via which for example data can be exchanged with the drawer 31 and/or with the bending press 11.

Provision is further made in or at the part accommodating unit 33, respectively, for a control electronics 125, which can perform controls at the bending parts and/or at the bending tools via corresponding sensors 127 or devices (e.g. a camera). For example, this control electronics 125 serves to capture an actual state of a bending tool.

Figure 4:
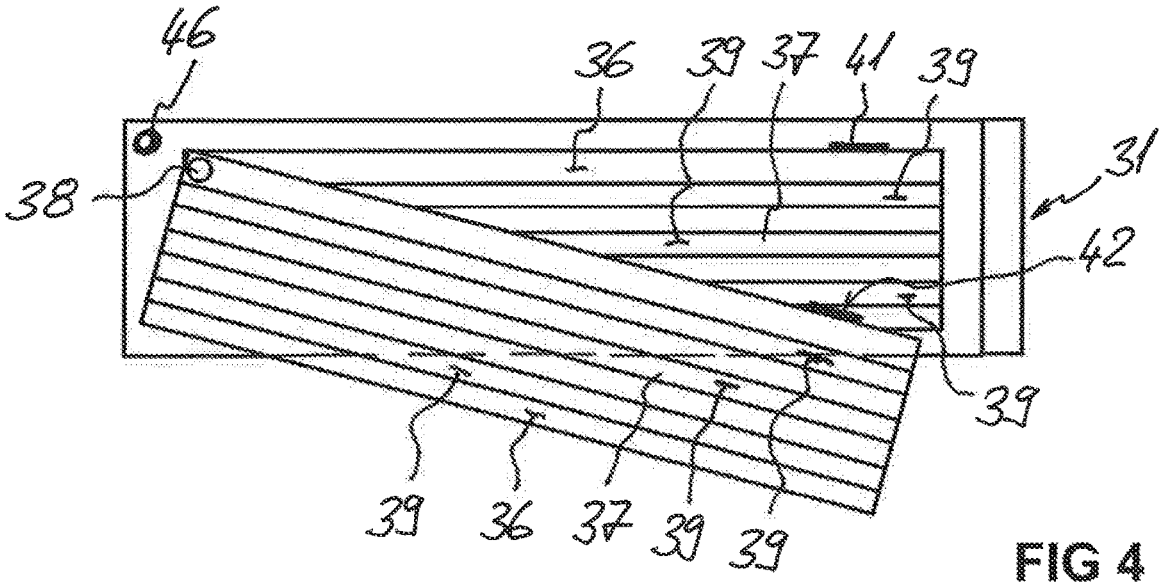
FIG. 4 shows a schematic top view onto the drawer.

The drawer 31 can furthermore be pivoted with respect to the housing 13 of the bending press 11 about the axis of rotation 46 and can be moved along the latter relative to the housing 13 of the bending press 11 (see FIG. 4). The drawer 31 can accordingly be positioned along the axis of rotation 46 in the height as needed. The drawer 31 can also be pivoted in such a manner that the operating space of the operator of the bending press 11 is limited less by the drawer 31 or is only limited slightly, respectively.

Figure 5:
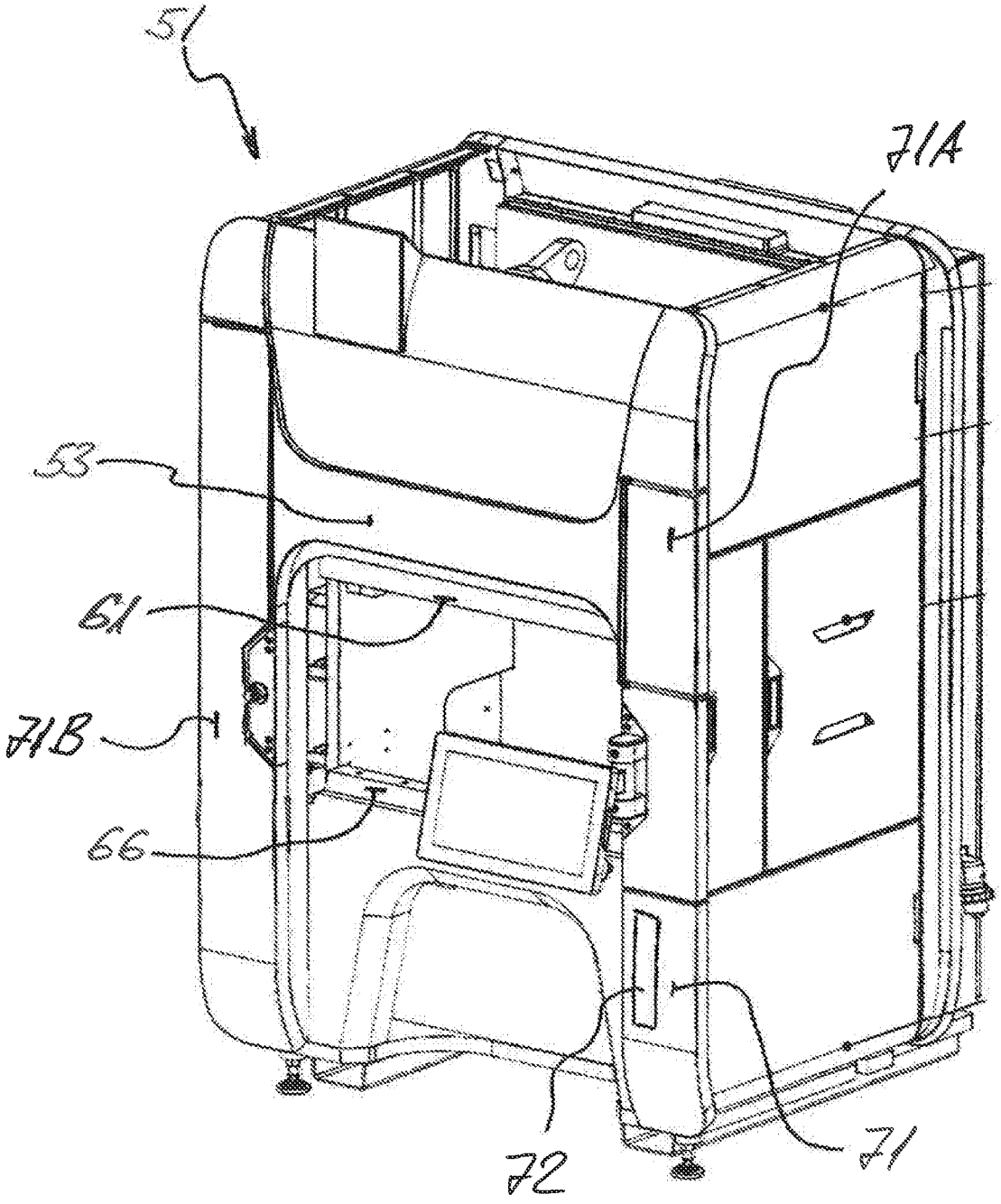
FIG. 5 shows a further embodiment of a bending press according to the invention in a perspective view.

In the case of the bending press 51 shown in FIG. 5, drawers 71, 71A and 71B, which are designed to accommodate bending tools, are arranged on both sides next to the lower beam 66 and next to the top beam 61. Based on the illustration at hand, the drawer 71 is arranged to the right of the lower beam 66. Based on the illustration at hand, the drawer 71A is arranged to the right of the top beam 61. Based on the illustration at hand, the drawer 71B is arranged to the left of the lower beam 66 as well as next to the top beam 61 and, in the example at hand, extends virtually cross the entire height of the bending press 51. The drawers 71, 71A and 71B are integrated in the housing 53 of the bending press 51.

Provision is made on the drawer 71 for a display unit 72, which is designed as screen. The operator can read the type and/or the number of the bending tools located in the drawer 71 on the integrated display unit 72. These data were provided to the controller of the bending press 51 in advance, for example, or were automatically captured via corresponding sensors. The drawer 71 itself can have a storage/control unit, which stores the data in connection with the parts accommodated in the drawer 71 or removed therefrom and has them displayed.

Figure 6:
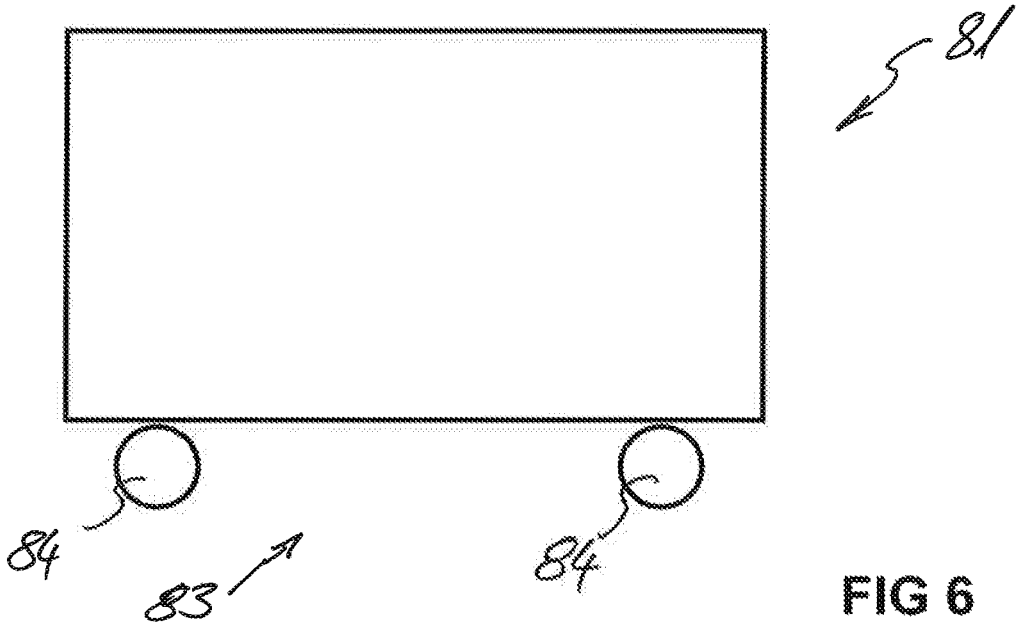
FIG. 6 shows a drawer in a schematic side view.

FIG. 6 illustrates a drawer 81, which can be separated from a bending press. This drawer 81 has a traversing unit 83, which comprises a plurality of rollers 84.

Provision can be made on this drawer 81, but also on the other embodiments of the drawers 31, 71, 91, 101 described herein for connecting parts for connecting a plurality of these drawers to one another. Bending cells can be realized with this by means of a plurality of bending presses for example, which are designed for a continuous processing of bending parts in these bending presses. These connecting parts are designed, e.g., as conveying devices, so that bending parts can easily be transported or transferred, respectively, from one bending press to the next bending press.

Figure 7:
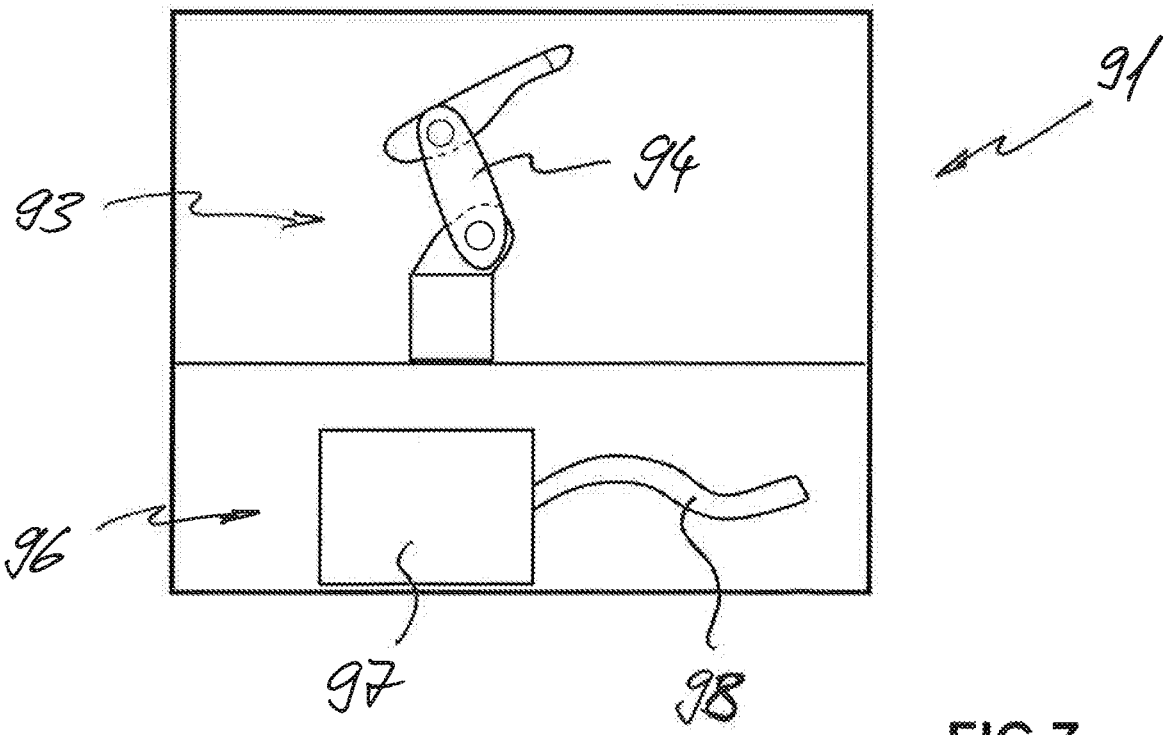
FIG. 7 shows a further drawer in a schematic side view.

Provision is made in the drawer 91 (see FIG. 7) for two assistance devices 93 and 96. The assistance device 93 is designed as a robot 94. The assistance device 96 comprises a power generating device 97 in the form of a compressor and a power supply device 98 in the form of a compressed air tube.

Figure 8:
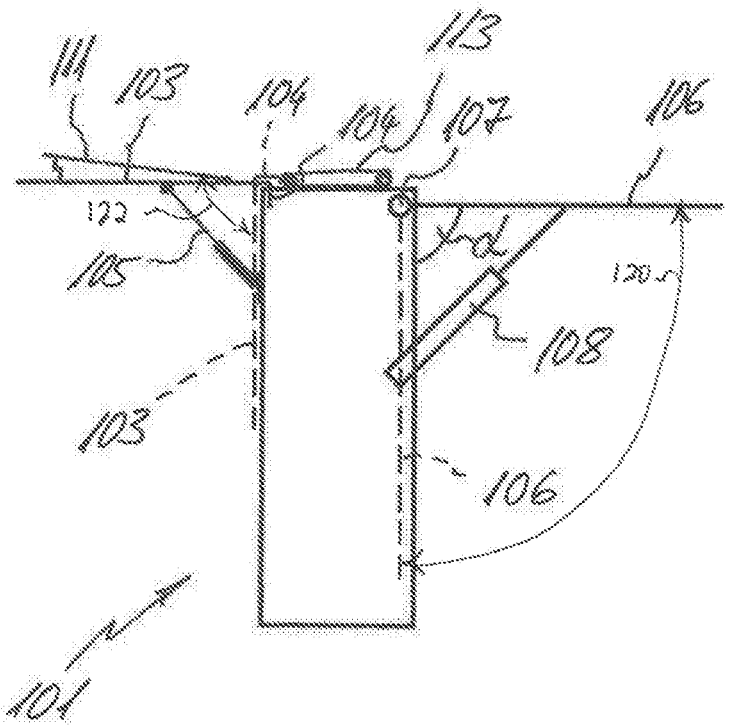
FIG. 8 shows a drawer comprising support elements in a schematic front view.

As shown in FIG. 8, the drawer 101 has a support element 103 arranged thereon, which is illustrated in the stored state (dashed line) on the one hand and in the use state (continuous line). The support element 103 comprises a schematically illustrated hook element 104, via which the support element 103 can be arranged on the drawer 101 in one of the two shown positions 122. By means of a support 105, which can advantageously be adjusted in its length, the angular orientation of the support element 103 can be adapted relative to the drawer 101.

The drawer 101 further has a support element 106 arranged therein, which is also illustrated in the stored state (dashed line) on the one hand and in the use state (continuous line) on the other. The support element 106 can be pivoted relative to the drawer 101 about a pivot axis 107. Provision is made for a drive device 108, here a gas pressure spring, for pivoting 120 the support element 106. The drive device 108 is advantageously controlled, so that any angular orientation (angle $\alpha$) of the support element 106 relative to the drawer 101 can be set. Provision is advantageously made for an automatism, so that the support element 106 transfers into a position vertically to the drawer 101 in response to the activation of the drive device 108—without mutual influencing by the operator or a controller.

Provision is made on the support element 103 for a conveying device 111, which is designed in a chute-shaped manner, for bending parts and/or bending tools, the incline of which can be set relative to the support element 103. The drawer 101 also has a further conveying device 113, which is designed as conveyor belt. The conveying device 111 provided on the support element 103 can also be designed as conveyor belt—an alternative not illustrated here—and the conveying device 113 could also be designed as chute.

REFERENCE LIST

| | |
|---|---|
| 11 | bending press |
| 13 | housing |
| 21 | top beam |
| 26 | lower beam |
| 31 | drawer |
| 32 | accommodating area of the drawer |
| 33 | part accommodating unit |
| 34 | guide rail |
| 35 | lock |
| 36 | bending tool accommodating unit |
| 37 | accommodating holder |
| 38 | pivot axis of 36 |
| 39 | accommodating slit |
| 40 | holding device |
| 41 | counter magnet |
| 42 | magnet |
| 43 | display unit |
| 44 | display unit |
| 46 | axis of rotation of 31 |
| 48 | motor unit of 31 |
| 49 | sensor |
| 51 | bending press |
| 53 | housing |
| 61 | top beam |
| 66 | lower beam |
| 71 | drawer |
| 72 | display unit |
| 81 | drawer |
| 83 | traversing unit |
| 84 | roller |
| 91 | drawer |
| 93 | assistance device |
| 94 | robot |
| 96 | assistance device |
| 97 | power generating device |
| 98 | power supply device |
| 101 | drawer |
| 103 | support element |
| 104 | hook element of 103 |
| 105 | support of 103 |
| 106 | support element |
| 107 | pivot axis |
| 108 | drive device of 106 |

-continued

| REFERENCE LIST | |
|---|---|
| 111 | conveying device |
| 113 | conveying device |
| 121 | electrical interface |
| 123 | electronic interface |
| 125 | control electronics |
| 127 | sensor |

What is claimed is:

1. A bending press for bending metal sheets comprising a housing, a top beam and a lower beam as well as comprising at least one drawer, the bending press comprising at least one drawer integrated within the housing adjacent to the top beam or the lower beam, the at least one drawer comprising at least one bending tool unit for bending tools and/or at least one part accommodating unit for parts, wherein the at least one bending tool unit and/or the at least one part accommodating unit is arranged to pivot out of the at least one drawer.

2. The bending press according to claim 1, characterized in that a plurality of drawers is provided, wherein the drawers are arranged on both sides of the top beam or on both sides of the lower beam or next to the top beam and the lower beam.

3. The bending press according to claim 2, characterized in that the at least one bending tool accommodating unit and/or the at least one part accommodating unit has at least one accommodating holder for at least one bending tool or for at least one part, respectively.

4. The bending press according to claim 3, characterized in that a holding device for temporarily holding the at least one bending tool accommodating unit and/or the at least one part accommodating unit in the at least one drawer is provided, wherein the holding device is designed mechanically or magnetically.

5. The bending press according to claim 1, characterized in that the at least one drawer is arranged to pivot away from the housing of the bending press.

6. The bending press according to claim 1, characterized in that a motor unit for moving the at least one drawer is provided, wherein the motor unit is sensor-controlled.

7. The bending press according to claim 1, characterized in that the at least one drawer can be separated from the bending press and comprises a traversing unit.

8. The bending press according to claim 1, characterized in that at least one assistance device is provided in the at least one drawer, wherein the at least one assistance device comprises at least one robot and/or at least one power generating device and/or at least one power supply device.

9. The bending press according to claim 1, characterized in that at least one support element is provided.

10. The bending press according to claim 9, characterized in that at least one support element is arranged on or in the at least one drawer, the at least one support element arranged to be moved relative to the at least one drawer, and wherein the bending press further comprises at least one drive device for moving the at least one support element.

11. The bending press according to claim 1, characterized in that at least one conveying device for bending parts and/or bending tools is provided on or in the at least one drawer, wherein the at least one conveying device is provided on the at least one support element.

12. The bending press according to claim 1, characterized in that at least one display unit is provided on or in the at least one drawer.

13. The bending press according to claim 12, characterized in that the at least one display unit is arranged at at least one bending tool accommodating unit and/or at at least one part accommodating unit.

14. The bending press according to claim 1, characterized in that at least one electronic interface or an electrical interface is provided on or in the at least one drawer.

15. The bending press according to claim 1, characterized in that at least one sensor is provided on or in the at least one drawer.

16. The bending press according to claim 1, characterized in that the at least one drawer can be locked.

* * * * *